US006367081B1

(12) United States Patent
Harris

(10) Patent No.: US 6,367,081 B1
(45) Date of Patent: Apr. 9, 2002

(54) METHOD AND APPARATUS FOR PROTECTING HANDS AND IMPROVING GRIP

(76) Inventor: Mark A. Harris, 2014 35th Avenue Ct., Greeley, CO (US) 80634

( * ) Notice: Subject to any disclaimer, the term of this patent is extended or adjusted under 35 U.S.C. 154(b) by 0 days.

(21) Appl. No.: 09/846,997

(22) Filed: Apr. 30, 2001

(51) Int. Cl.[7] ..... A61F 9/00
(52) U.S. Cl. ..... 2/16; 2/20
(58) Field of Search ..... 2/16, 167

(56) References Cited

U.S. PATENT DOCUMENTS

| | | | | | |
|---|---|---|---|---|---|
| 1,402,799 | A | | 1/1922 | Ryan | |
| 2,867,814 | A | | 1/1959 | Miles, Jr. | 2/20 |
| 3,598,408 | A | | 8/1971 | Klose | 273/54 B |
| 3,971,374 | A | | 7/1976 | Wagner | 128/155 |
| 4,658,441 | A | | 4/1987 | Smith | 2/16 |
| 4,748,975 | A | | 6/1988 | Yashima | 128/155 |
| 4,977,621 | A | | 12/1990 | Richard | 2/20 |
| 5,003,638 | A | * | 4/1991 | Miyake et al. | 2/167 |
| 5,180,605 | A | * | 1/1993 | Milner | 427/2 |
| 5,350,418 | A | * | 9/1994 | Janevski et al. | 607/111 |
| 5,479,660 | A | * | 1/1996 | Najac | 2/20 |
| 5,600,853 | A | | 2/1997 | Yewer, Jr. | 2/161.1 |
| 5,804,011 | A | * | 9/1998 | Dutta et al. | 156/160 |

* cited by examiner

*Primary Examiner*—John J. Calvert
*Assistant Examiner*—James G Smith
(74) *Attorney, Agent, or Firm*—Sheridan Ross P.C.

(57) ABSTRACT

A method and an apparatus for protecting and improving the grip of hands are disclosed. According to the invention, an abrasion-resistant material having an adhesive on one side is affixed to a hand of a user, such that the palm of the hand is protected. Tabs may be provided for protecting the sides of the hand and the thumb, and for securing the device to the hand. According to one embodiment of the present invention, the device is asymmetrical, and is supplied in left and right hand versions. The device may be constructed from cloth having an adhesive backing. The present invention protects the hands from abrasion, while promoting grip and avoiding overheating and bunching. In addition, the device of the present invention is inexpensive, and therefore a device in accordance with the invention may be discarded after use.

21 Claims, 3 Drawing Sheets

METHOD AND APPARATUS FOR PROTECTING HANDS AND IMPROVING GRIP

FIELD OF THE INVENTION

The present invention relates to protecting and improving the grip of human hands. In particular, the present invention relates to the protection of hands from abrasion, such as may be encountering during weightlifting or other such activities, and for improving grip during such activities.

BACKGROUND OF THE INVENTION

In many types of activities, the human hand is used to grasp and lift a bar, ring or handle. Although the human hand is well adapted for such activities, the skin covering the palm of the hand and the thumb is prone to developing blisters or calluses as a result of such use. In addition, sweating during such activities can make grasping objects difficult and less secure.

In order to protect hands and enhance grip, gloves are commonly used. However, gloves are hot, because they cover all or a substantial portion of the hand. In addition, gloves may suffer from bunching of the material from which the glove is constructed between the hand and the object being grasped, causing discomfort. Gloves can also impair circulation. Additionally, gloves are prone to deterioration, and can be unhygienic when used repeatedly.

In order to enhance grip, weight lifters and other athletes may apply powdered chalk to their hands. However, powdered chalk is messy and must be repeatedly applied. In addition, chalk is not particularly effective in reducing the development of blisters and calluses.

As still another method of protecting hands, tape may be applied to the affected surfaces of the hand. However, tape is typically applied by wrapping it about the hand, including the areas to be protected, multiple times. As a result, the tape covers portions of the hand not requiring protection. Accordingly, tape is wasted and areas of the hand that would otherwise be cooled by the ambient air are covered. Furthermore, tape can be time consuming and difficult to apply, and can limit the hand's range of motion.

It would be desirable to provide a method and apparatus by which the palms of a person's hands could be protected when grasping objects. In particular, it would be desirable to provide a method and apparatus for protecting a person's hands during weight lifting and other repetitive activities that was effective in reducing or eliminating blisters and calluses. Furthermore, it would be advantageous to provide such a method and apparatus that allowed those portions of the hand not requiring protection to be exposed to the ambient air, that did not bunch uncomfortably between the hand and the object being grasped, and that did not impair circulation. Additionally, it would be advantageous to provide a method and apparatus for enhancing grip. Furthermore, it would be advantageous to provide such a method and apparatus that was easy to use, inexpensive and hygienic.

SUMMARY OF THE INVENTION

In accordance with the present invention, a method and an apparatus for protecting hands and improving grip are provided. The method and apparatus of the present invention provide an abrasion resistant material that is adhered to the palm of the hand to protect the hand from blistering and calluses and to improve grip. The method and apparatus of the present invention are particularly useful in connection with repetitive, high exertion activities, such as weight lifting.

According to one embodiment of the present invention, a device for protecting hands and improving grip is provided. The device includes a sheet of abrasion resistant material, one side of which is substantially covered by an adhesive. The material is shaped to conform to a hand. In particular, the material may be shaped to form a body portion that is curved to follow the arc described by the top of the hand where the palm joins the base of the fingers, and may be dimensioned to cover the upper portion of a palm from the ulnar side to the radial side of the hand. A tab may be provided at a first end of the body for wrapping about the ulnar side of the hand, protecting that portion of the hand, and extending to the back of the hand, to ensure the secure attachment of the material to the hand. A second tab may be provided at a second end of the body for wrapping about the radial side of the hand and attachment across at least a portion of the back of the hand. According to a further embodiment of the present invention, a third tab may be provided at the second end of the body for wrapping about the thumb to further secure the device and to provide protection to surfaces on the thumb.

In accordance with one embodiment of the present invention, the device is asymmetrical, with a device adapted for use on a right hand being the mirror image of a device adapted for use on the left hand. According to still another embodiment of the present invention, an adhesive material is applied to all or a substantial portion of one side of the abrasion resistant material. A film may be used to protect the adhesive material prior to use. The film is then removed to allow the device to be adhered to the hand.

According to a further embodiment of the present invention, a method for protecting hands and improving grip is disclosed. According to the method, an abrasion resistant material is adhered to at least a portion of the palm of a hand. A first tab of the abrasion resistant material is wrapped about an ulnar side of the hand and adhered to the back of the hand. A second tab is extended between the fore finger and thumb of the hand, and is wrapped about a radial side of the hand and adhered to the back of the hand. According to a further embodiment, a third tab is wrapped about the thumb of the hand, to protect the thumb and to further secure the abrasion resistant material to the hand.

According to still another embodiment of the present invention, the device is formed from cloth tape. According to a further embodiment, the material is breathable. According to yet another embodiment of the present invention, the abrasion resistant material incorporates or is associated with padding or additional layers of material where protection against impacts or added abrasion resistance is desired. The abrasion resistant material may also be treated with an antibacterial compound. According to still another embodiment of the present invention, the material is treated with a compound to further improve grip.

Based on the foregoing summary, a number of salient features provided by the present invention may be discerned. The present invention provides a method and apparatus for protecting hands and improving grip. In particular, the method and apparatus of the present invention protects hands from abrasion and improves grip, while eliminating or avoiding bunching of the protective material between the hand and the object being grasped. In addition, the method and apparatus of the present invention allows large portions of the hand to remain uncovered, promoting cooling. In addition to protecting hands from blistering, inhibiting the formation of calluses and enhancing grip, the present invention may be disposed of after each use, thereby enhancing cleanliness. Furthermore, the device is adaptable to a wide range of hand shapes.

Additional advantages of the present invention will become readily apparent from the following discussion, particularly when taken together with the accompanying drawings.

DETAILED DESCRIPTION

Figure 1:
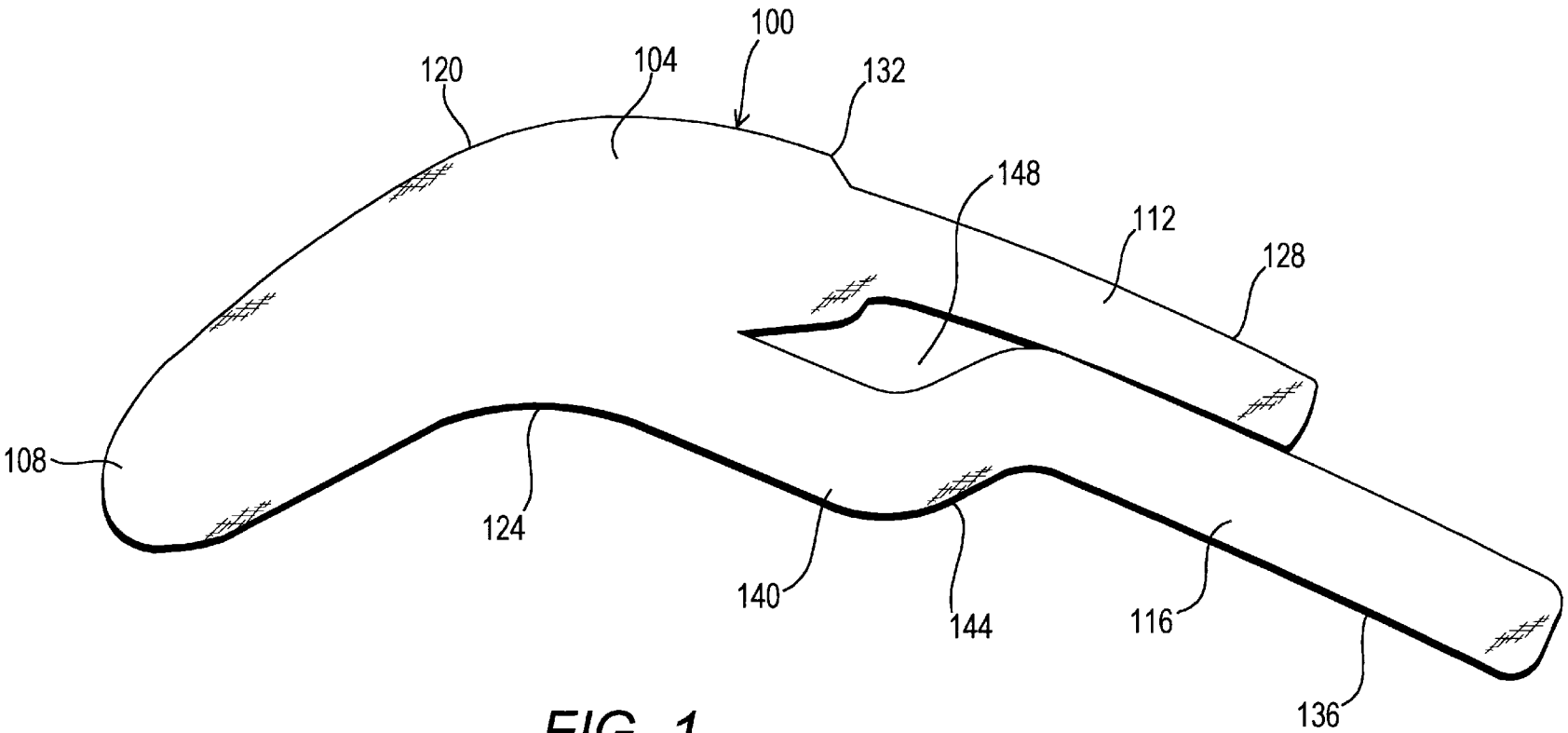
FIG. 1 is a plan view of a device in accordance with the present invention.

FIG. 1 is a plan view of a device 100 for protecting hands in accordance with the present invention. In general, the device 100 includes a body 104, a first tab 108, a second tab 112, and a third tab 116.

The body portion 104 includes a curved upper extent 120. In general, the curve of the upper extent 120 is adapted to follow the curve described by the intersection of the base of the fingers and the palm of a human hand. The body portion 104 also includes a curved lower extent 124. The curve of the lower extent 124 is adapted to allow the body 104 to adhere to the palm of a hand without gapping or bunching. The distance between the upper portion 120 and the lower portion 124 is adapted to cover at least the upper portion of a palm of a hand. In particular, the body portion 104 is adapted to cover the area of the palm from the base of the fingers to about the mid-section of the palm, so that the area of the palm adjacent to the joints between the proximal phalanges of the fingers and the metacarpal (i.e., the metacarpophalangeal joints) associated with each of the fingers is covered. This configuration is particular advantageous when a bar, such as a barbell, is grasped. For use in connection with other activities, the distance between the upper extent 120 and the lower extent 124 may be extended. For example, the upper extent 120 may be extended to cover a portion of the fingers, and the lower extent 124 may be extended to cover lower portions of the palm. Furthermore, the upper extent 120 may itself be divided into one or more fingers for extending along the fingers of the hand without inhibiting their movement. In addition, the curve of the lower extent 124 may be opposite the curve illustrated in FIG. 1. For example, in order to protect the lower portions of the palm, the lower portion 124 may describe a convex curve so that the body 104 of the device 100 extends to those lower portions of the palm.

The first tab 108 may extend from the body 104 a sufficient length to wrap around the ulnar side of the hand, to protect that portion of the hand. Smaller hands may be accommodated by wrapping the first tab 108 across a greater portion of the back of the hand. The first tab 108 may additionally be long enough to extend around at least a portion of the back of the hand, to ensure a secure attachment of the device 100 to the hand. The first tab 108 may be rounded to help prevent unintentional peeling of the device 100 from the hand.

The second tab 112 extends from a second end of the base portion 104. The second tab 112 may include distal 128 and proximal 132 portions. The distal portion 128 may be of sufficient length to extend between the thumb and forefinger of the hand, and to wrap around to the back of the hand, to ensure a secure attachment of the device 100. Alternatively, the second tab 112 may be wrapped about the forefinger. The proximal portion 132 may be wider than the distal portion 128 to provide protection of the radial side of the hand between the thumb and forefinger.

The device 100 may also include a third tab 116. The third tab may generally include a distal portion 136 and a proximal portion 140 that are substantially parallel to one another, and that are substantially parallel to the second tab 112. The distal portion 136 may be offset from the proximal portion 140 by offset 144. In general, the offset 144 positions the distal portion 136 of the third tab 116 such that it can be wrapped about the proximal phalanx of the thumb, thereby providing protection to that portion of the thumb. In addition, the proximal portion 140 of the third tab 116 may be positioned to protect the area adjacent to the joint between the metacarpal associated with the thumb and the proximal phalanx of the thumb.

The device 100 may additionally be configured such that an aperture 148 is formed between the second tab 112 and the third tab 116. The aperture 148 facilitates placement of the device 100 on the hand, as will be described further below.

The device 100, in accordance with one embodiment, is constructed from an abrasion resistant material that is flexible and to which an adhesive backing is or may be applied. The adhesive backing may cover all or substantial portions of the device 100 on one side of the device 100. In particular, the adhesive may be placed on the side of the device 100 that will be adjacent to the surface of the hand when it is in place. A protective film may be applied to the adhesive to protect the adhesive prior to use of the device 100. The device 100 may thus be formed by cutting a flat piece of adhesive backed cloth material in the shape illustrated in FIG. 1. Alternatively, the device 100 illustrated in FIG. 1 may be formed from smaller pieces of material, such as tape, lapp-jointed together to form a larger piece. Such jointing techniques may also be applied where, for instance, it is determined that in plan view, certain of the features (e.g., tabs 112 and 116) should overlap to obtain the desired fit when affixed to a hand. In addition to cloth of various weaves and compositions, the device 100 may be formed using materials such as rubber, leather, plastic or laminates.

It should be appreciated that the device illustrated in FIG. 1 is adapted for use on a right hand when an adhesive is applied to the side of the device opposite the viewer. Alternatively, the device 100 illustrated in FIG. 1 is suited for use on a left hand if the adhesive is placed on the side of the device 100 facing the viewer. Accordingly, the device 100 is asymrnmetrical, and may be provided in pairs.

Figure 2:
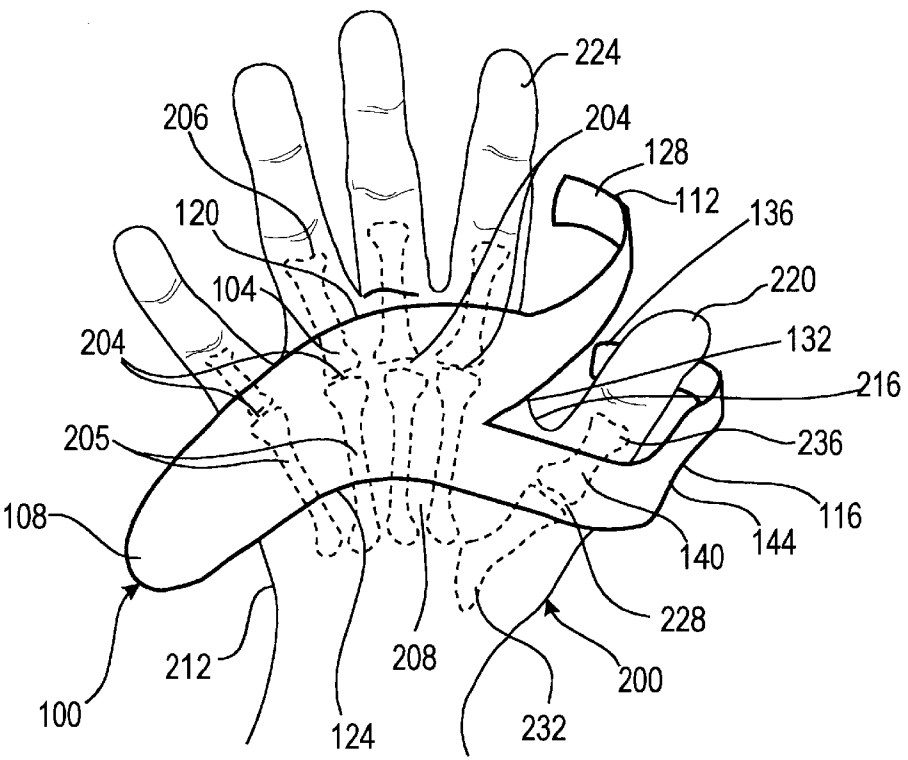
FIG. 2 is a palmar view of a hand, showing a device in accordance with the present invention being attached.

With reference now to FIG. 2, the device 100 of FIG. 1 is illustrated being affixed to the right hand 200 of a user. As mentioned above, the upper extent 120 of the body 104 is curved to follow the curve described by the base of the fingers. The lower extent 124 of the body 104 is spaced from the upper extent 120 to provide protection for the upper surface of the palm 208. In general, the body 104 of the embodiment illustrated in FIG. 2 covers at least the area of the palm adjacent to the metacarpophalangeal joints 204 between the metacarpals 205 and proximal phalanges 206 of the fingers. The first tab 108 can be seen to extend beyond the ulnar side 212 of the hand 200 to allow the device 100 to protect the ulnar side 212 of the hand 200, and to permit the first tab 108 to be affixed to the back of the hand 200.

The second tab 112 can be seen to extend beyond the radial side 216 of the hand, such that the proximal portion 132 can provide protection to the area between the thumb 220 and forefinger 224, and such that the distal portion 128 can be affixed to the back of the hand 200.

The proximal portion 140 of the third tab 116 extends from the body 104 to cover an area of the hand 200 adjacent to the joint 228 between the metacarpal of the thumb 232 and the proximal phalanx of the thumb 236. The offset 144 positions the distal portion 136 of the third tab 116 such that it can be wrapped about the thumb 220.

Figure 3:
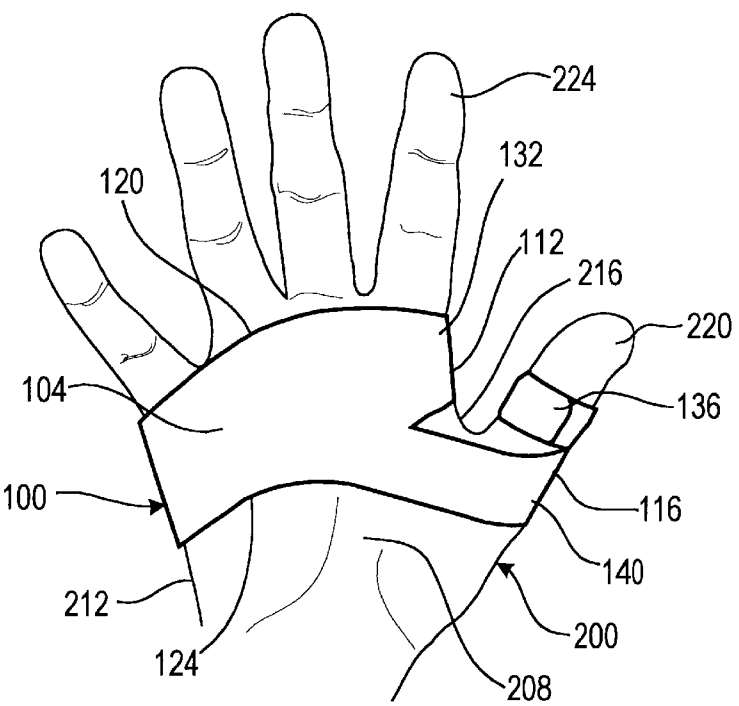
FIG. 3 is a palmar view of a hand with a device in accordance with the present invention attached.

With reference now to FIG. 3, a palmar view of the hand 200, with the device 100 affixed, is illustrated. It can be appreciated that the device 100 follows the contours of the hand 200, such that there is substantially no material standing proud from the surface of the hand 200. Furthermore, it can be appreciated that the device 100 protects the area of the hand 200 used to grasp objects such as barbells, without covering large portions of the hand 200 not used for such grasping. That is, the device 100 protects those portions of the hand 200 vulnerable to abrasion from a bar grasped by the hand 200, without covering substantial portions of the rest of the hand 200.

The first tab 108 (see, e.g., FIG. 2) extends about the ulnar side 212 of the hand, to protect that area of the hand 200. The proximal portion 132 of the second tab 112 extends about the radial side 216 of the hand 200 between the forefinger 224 and thumb 220, thereby protecting that area of the hand 200. The proximal portion 140 of the third tab 116 extends from the palm 208 to the base of the thumb 220. In addition, the distal portion 136 of the third tab 116 is wrapped about the thumb 220, providing protection to the thumb 220 and helping to secure the device 100 to the hand 200.

Figure 4:
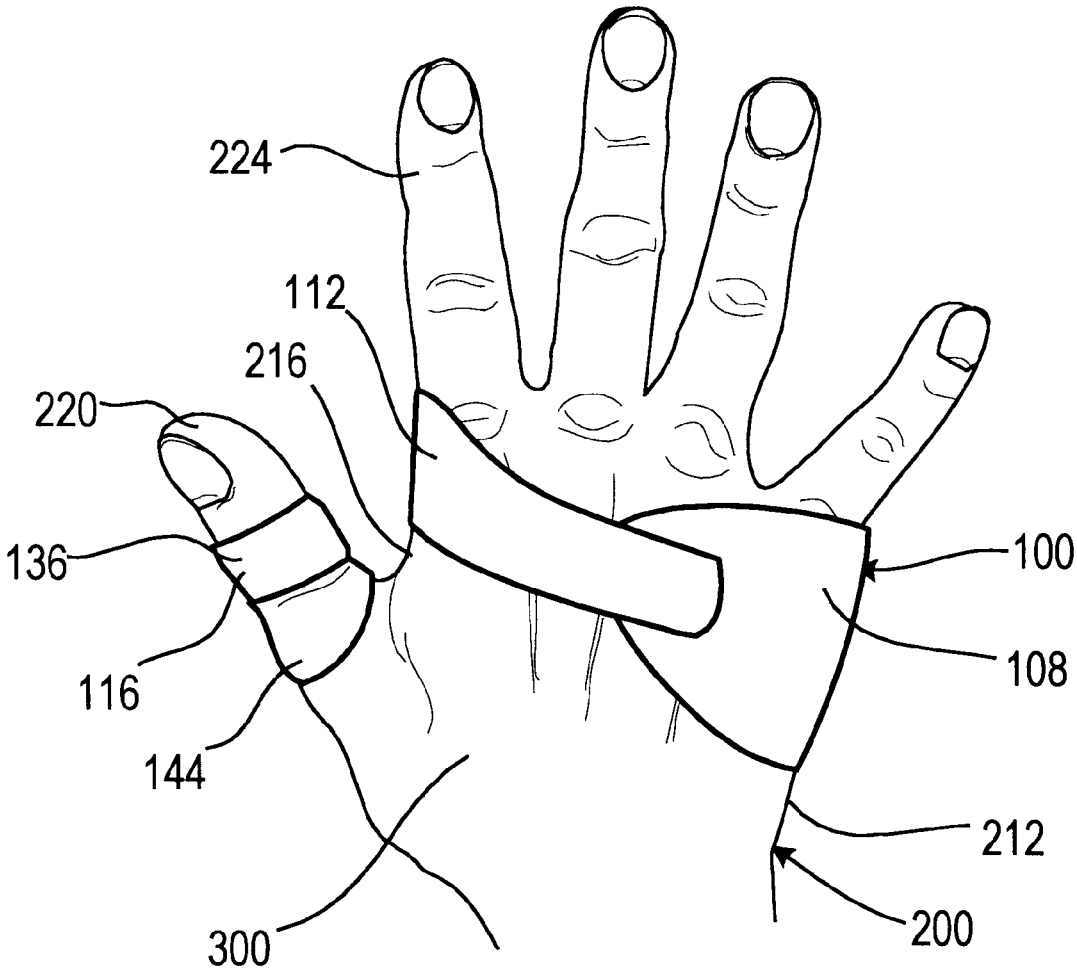
FIG. 4 shows the back of the hand illustrated in FIG. 3, with a device in accordance with the present invention attached.

With reference now to FIG. 4, the back of the hand 200 illustrated in FIGS. 2 and 3, with the device 100 attached, is illustrated. The first tab 108 can be seen in its position affixed to the back 300 of the hand 200. As mentioned above, it can be appreciated that the width of the first tab 108 allows the device 100 to protect the ulnar side 212 of the hand 200.

The second tab 112 can be seen extending about the radial side 216 of the hand 200, protecting the area between the thumb 220 and forefinger 224 as mentioned above, and further securing the device 100 to the hand 200. In the embodiment illustrated in FIG. 4, the second tab 112 is of sufficient length to extend across three knuckles of the hand 200. Although the relatively long second tab 112 illustrated in FIG. 4 increases the security of the attachment of the device 100 to the hand 200, it is not required. For example, the second tab 112 can be shorter so that it extends across only a portion of one knuckle of the hand 200. The offset 144 and the distal portion 136 of the third tab 116 can be seen in their position on the thumb 220, protecting the thumb 220 and further securing the device 100 to the hand 200.

In a preferred embodiment of the present invention, the entire surface of the device 100 to be positioned adjacent to the hand 200 is provided with an adhesive. Providing the entire surface of the device 100 with an adhesive prevents shifting of the device 100 relative to the surface of the hand 200. This in turn prevents a potential source of friction, and thus blistering. In addition, providing adhesive over the entire surface prevents bunching of the device 100 between the object being grasped and the hand 200. In particular, providing an adhesive over the entire surface of the device 100 adjacent to the surface of the hand 200 allows the device 100 to move with the skin on the hand 200, to maximize comfort and protection. According to alternative embodiment of the present invention, adhesive may be applied to less than all of the surface of the device 100 adjacent to the surface of the hand 200. In general, enough adhesive should be applied to ensure that the device 100 is maintained in the desired position during use.

The adhesive may be of the type commonly used in connection with tapes used for securing bandages and providing support to joints, such as may be used by sports trainers in connection with athletes. In particular, the adhesive may be resistant to separation from the hand due to moisture, such as sweat. Accordingly, the material from which the device 100 is formed may comprise an abrasion resistant material with an adhesive backing, or to which an adhesive backing may be applied. For example, the device 100 may be formed from material such as is used in the above-described tapes.

In addition to being abrasion resistant, the material used to form the device 100 may, in accordance with one embodiment of the present invention, be breathable. To further promote cooling, the device 100 may be provided with perforations, or with cut outs in areas where coverage of the hand 200 is not desired.

In use, any protective film or other material provided to maintain the adhesion of the adhesive backing is first removed. Alternatively, the pair of devices may be adhered together, in which case the individual devices of the pair must be removed from one another. The device 100 is then positioned with respect to the appropriate hand 200. For example, in connection with the device 100 configured for use on the right hand, the device 100 is positioned with respect to the hand 200 as illustrated in FIG. 2. In particular, the body 104 of the device 100 is positioned along the top of the palm 208 of the hand 200, to protect the area of the hand 200 adjacent the joints 204 between the base of the fingers and the hand 200, with the thumb 220 extending through the aperture 148 (see FIG. 1) formed between the second 112 and third 116 tabs. The body 104 may then be pressed against the palm 208 of the hand 200 to secure the device 100 to the hand 200.

Next, the first tab 108 may be wrapped about the ulnar side 212 of the hand 200, and affixed to the back 300 of the hand 200 (see FIG. 4). The second tab 112 may then be brought around the radial side 216 of the hand 200, between the thumb 220 and forefinger 224, and secured to the back 300 of the hand 200. The proximal portion 140 of the third tab 116 is positioned so that it is adjacent the joint between the palm and the base of the thumb 220. The distal portion 136 may then be wrapped about the thumb 220, completing the affixation of the device 100 to the hand 200.

In general, the device 100 should be affixed to the hand 200 such that the device 100 follows the contours of the hand 200 as closely as possible. This allows the device 100 to move with the surface of the hand 200, eliminating friction and preventing bunching. Furthermore, the amount by which the first 108 and second 112 tabs extend across the back 300 of the hand 200, and their position on the hand 200, will vary, depending on the size and shape of the hand 200 to which the device 100 is applied. That is, for a given size of device 100, the tabs 108 and 112 will extend a greater distance across the back of a relatively small hand 200, and a lesser distance across the back of a relatively large hand 200.

The device 100 is typically adapted for disposal after use. Disposing the device 100 after use promotes hygiene. In particular, the problems often associated with reusable devices, including the build-up of dirt and odor, are obviated by disposing of the device after use. Furthermore, because the device 100 can be produced at low cost, use of the device may be economical even when the device 100 is disposed of after each use. For convenience, the device 100 may be sold in packages containing multiple pairs of the device 100. For example, the devices may be packaged in pad form, with each leaf in the pad containing a pair of the devices 100. Alternatively, the devices 100 may be packaged in dispensers that are similar to tissue boxes. As a further alternative, the devices 100 may be packaged in roll form.

Where impact protection or additional resistance to abrasion is desired, additional layers of material and/or padding may be provided. In addition, antibacterial compounds may be incorporated into the device to further enhance the hygienic nature of the device. According to still another embodiment of the present invention, the adhesive used may be capable of reapplication to a hand 200, allowing for multiple uses of the device 100. For uses in which increasing grip is of particular concern, a tacky substance or layer may be applied. For example, the adhesive may be applied to both sides of the device. The material of the device may also be selected for desired grip enhancing qualities.

As mentioned above, the device 100, as illustrated, is asymmetrical, and therefore is provided in left and right hand versions. In addition, the device 100 may be provided in a variety of sizes, to ensure a good fit in connection with hands 200 of different sizes.

Although the figures and description above are generally directed to a particular embodiment of the present invention, it should be appreciated that other configurations are possible. For instance, the length of the tabs 108, 112 and 116 may be shortened, for instance when the device 100 is to be used for shorter time periods. Furthermore, portions of the illustrated device 100 may be extended, or various appendages added, to provide protection to other areas of the hand 200. As a further alternative, the device 100 may be provided in a symmetrical configuration, by eliminating the third tab 116 and modifying the shape of the first and/or second tabs 108 and 112, so that left and right hand versions are not required.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiments described hereinabove are further intended to explain the best mode presently known of practicing the invention and to enable others skilled in the art to utilize the invention in such or in other embodiments and with various modifications required by their particular application or use of the invention. It is intended that the appended claims be construed to include the alternative embodiments to the extent permitted by the prior art.

What is claimed is:

1. A device for protecting hands, comprising:

an abrasion resistant material comprising:

a body portion, having a width sufficient to extend at least from an ulnar side of a palm of a human hand to a radial side of a palm of said human hand, wherein at least an upper extent of said body portion is curved;

a first tab at a first end of said body portion, a second tab at a second end of said body portion, wherein said second tab is adapted to extend between a thumb and a forefinger of said human hand; and an adhesive on at least portions of a side of said abrasion resistant material.

2. The device of claim 1, further comprising a third tab at said second end of said body portion, wherein said second tab and said third tab define a thumb aperture.

3. The device of claim 1, wherein said device is for use in protecting a right hand, and wherein said adhesive is placed on a first side of said abrasion resistant material.

4. The device of claim 1, wherein said device is for use in protecting a left hand, and wherein said adhesive is placed on a second side of said abrasion resistant material.

5. The device of claim 1, wherein said abrasion resistant material is asymmetrical.

6. The device of claim 1, wherein said abrasion resistant material is formed from a flat piece of material.

7. The device of claim 1, wherein said abrasion resistant material is formed from adhesive-backed cloth tape.

8. The device of claim 1, wherein a top extent of said body portion is curved.

9. The device of claim 1, wherein said first tab is rounded.

10. The device of claim 1, wherein said second tab has a length sufficient to allow said second tab to extend across substantially all of a back of said human hand.

11. The device of claim 2, wherein said third tab comprises a base portion and a distal portion, and wherein said distal portion is offset from and substantially parallel to said base portion.

12. The device of claim 1, wherein said first tab has a length sufficient to allow said first tab to cover a substantial portion of an ulnar side of said human hand.

13. The device of claim 1, wherein said abrasion resistant material is breathable.

14. The device of claim 1, further comprising a layer of padding interposed between said adhesive and said abrasion resistant material.

15. The device of claim 1, further comprising an antibacterial compound.

16. A method for protecting a hand, comprising:

adhering a body portion of an abrasion resistant material to at least a portion of a palm of said hand, wherein at least an upper extent of said body portion is curved;

wrapping a first tab of said abrasion resistant material about an ulnar side of said hand and adhering said tab on back of said hand;

extending a second tab of said abrasion resistant material between a forefinger and a thumb of said hand; and wrapping said second tab about a radial side of said hand and adhering said second tab to a back of said hand, wherein said at least a portion of said palm of said hand is protected from abrasion.

17. The method of claim 16, further comprising wrapping a third tab about said thumb.

18. The method of claim 16, wherein said abrasion resistant material comprises an adhesive backed tape.

19. The method of claim 18, wherein said tape is a cloth tape.

20. The method of claim 16, further comprising disposing of said abrasion resistant material after use.

21. A device for protecting hands, comprising:

a plat piece of abrasion resistant material, comprising:

a body portion;

a first tab at a first end of said body portion;

a second at a second end of said body portion;

a third tab at said second end of said body portion, wherein an aperture is formed between said second tab and said third tab; and an adhesive on at least portions of one side of said device for adhering said device to a hand.

* * * * *

UNITED STATES PATENT AND TRADEMARK OFFICE

CERTIFICATE OF CORRECTION

PATENT NO. : 6,367,081 B1
DATED : April 9, 2002
INVENTOR(S) : Harris

It is certified that error appears in the above-identified patent and that said Letters Patent is hereby corrected as shown below:

Column 8,
Line 39, please add -- a -- before the word “back”;
Line 56, please replace the word “plat” with -- flat --; and
Line 59, please add -- tab -- after the word “second”.

Signed and Sealed this

Fifth Day of November, 2002

*Attest:*

*Attesting Officer*

JAMES E. ROGAN
*Director of the United States Patent and Trademark Office*